US011530507B2

(12) United States Patent
Perosa et al.

(10) Patent No.: US 11,530,507 B2
(45) Date of Patent: Dec. 20, 2022

(54) LAUNDRY WASHING MACHINE

(71) Applicant: Electrolux Appliances Aktiebolag, Stockholm (SE)

(72) Inventors: Vittorio Perosa, Gruaro (IT); Alessandro Bruna, Porcia (IT)

(73) Assignee: Electrolux Appliances Aktiebolag

( * ) Notice: Subject to any disclaimer, the term of this patent is extended or adjusted under 35 U.S.C. 154(b) by 8 days.

(21) Appl. No.: 17/369,353

(22) Filed: Jul. 7, 2021

(65) Prior Publication Data

US 2022/0010477 A1 Jan. 13, 2022

(30) Foreign Application Priority Data

Jul. 10, 2020 (EP) ..... 20185373

(51) Int. Cl.

| | |
|---|---|
| ***D06F 39/08*** | (2006.01) |
| *D06F 103/18* | (2020.01) |
| *D06F 105/06* | (2020.01) |
| *D06F 105/02* | (2020.01) |

(52) U.S. Cl.

CPC ..... *D06F 39/087* (2013.01); *D06F 39/085* (2013.01); *D06F 39/088* (2013.01); *D06F 2103/18* (2020.02); *D06F 2105/02* (2020.02); *D06F 2105/06* (2020.02)

(58) Field of Classification Search

CPC ..... D06F 39/087

See application file for complete search history.

(56) References Cited

FOREIGN PATENT DOCUMENTS

| | | | |
|---|---|---|---|
| EP | 2746450 | A1 | 6/2014 |
| EP | 3486365 | A1 | 5/2019 |
| JP | 2015062508 | A | 4/2015 |
| KR | 20130143474 | A | 12/2013 |

OTHER PUBLICATIONS

Extended European Search Report for European Application No. 20185373.6, dated Nov. 20, 2020, 8 pages.

*Primary Examiner* — Jason Y Ko

(74) *Attorney, Agent, or Firm* — RatnerPrestia

(57) ABSTRACT

A laundry washing machine comprising: a cabinet; a tub inside the cabinet and comprising a first and second shells fixed together and defining a sump at a bottom region of the tub; a rotatable drum in the tub; a draining circuit fluidly connected to the sump for draining liquid from the bottom of the latter; a level detection device configured for detecting the level of liquid within the tub and comprising an air chamber having a liquid inlet provided at the sump and in fluid communication with the internal of the latter; and a recirculation circuit configured for withdrawing liquid from the tub and to re-admit such a liquid into the tub through an outlet opening positioned in the sump. The outlet opening of the recirculation circuit and the liquid inlet of the level detection device are located one on the first shell and the other on second shell.

15 Claims, 10 Drawing Sheets

LAUNDRY WASHING MACHINE

This Application claims the benefit of and priority to European Application EP 20185373.6, filed on Jul. 10, 2020, which is incorporated herein by reference

FIELD OF THE INVENTION

The present invention refers to a laundry washing machine (called also washing machine).

BACKGROUND

Nowadays washing machines, both "simple" washing machines (i.e. washing machines which can only wash and rinse the laundry) and washing-drying machines (or "washer-driers", i.e. washing machines which can also dry the laundry), usually comprise an external casing (called also cabinet) housing a washing tub (called also tub), typically suspended to the cabinet through springs and dampers, and in which a washing drum (called also drum) is rotatably contained.

A loading/unloading door, typically hinged to the cabinet, ensures access to the tub and the drum.

In some known laundry washing machines, the tub comprises (e.g. is composed of) two shells, which are connected to one another (e.g. by welding) in such a way that the connection is watertight; the shells are so shaped to define, at a bottom region of the tub, a sump, which is fluidly connected to a draining circuit for draining liquid from the bottom of the latter.

Known laundry washing machines comprise a detergent supply unit and a water inlet circuit for the introduction of water and washing/rinsing products (i.e. detergent, softener, etc.) into the tub.

Known laundry washing machines typically comprise a level detection device, configured for detecting the level of liquid within the tub; the liquid level detected by this device is used, for example, to correctly activate the water inlet circuit during the washing cycle.

Level detection devices of known type typically comprise a pressure sensor, or pressure switch, which communicates with an air volume enclosed in an air chamber via a narrow conduit. The air chamber is typically arranged in the bottom part of the tub and is in fluid communication with the internal of the latter by a liquid inlet; the air volume enclosed above the liquid entering the air chamber through the liquid inlet is therefore subjected to a pressure which is sensed by the pressure sensor, and then translated into a measure of the liquid level in the tub.

Some known laundry washing machines are also provided with a recirculation circuit configured for withdrawing liquid from the tub and to re-admit such a liquid into the tub through an outlet opening positioned in the sump; in this way such a liquid, which is typically water containing a washing and/or rinsing additive (e.g. detergent and/or softener) can be effectively mixed, so as to effectively dilute the washing and/or rinsing additive in the water.

Known laundry washing machines provided with both above described level detection device and recirculation circuit have however some drawbacks; in fact, it is known that laundry washing machines have strict dimensional constraints, due to modularity of the appliance cabinet and its footprint, in particular fixing the maximum external dimensions of the cabinet, that impose restrictions to the positioning of the various components within the cabinet in order to match the external dimensions constraints. In particular, the recirculation circuit and the level detection device comprise many components (pump, ducts sensors, etc.) and therefore they take up much space within the cabinet, which makes their positioning and assembly much cumbersome.

In such known laundry washing machines, therefore, in particular in order to fulfill external dimensions constraints, there is the need of finding a way for optimizing the positioning of the recirculation circuit and the level detection device within the cabinet.

SUMMARY

The aim of the present invention is therefore to provide a laundry washing machine provided with a recirculation circuit and with a level detection device which position within the cabinet allows to fulfill the external dimension constraints.

Within this aim, a further object of the invention is obtaining a laundry washing machine in which the level detection device can effectively detect the level of a liquid contained within the tub.

A further object of the present invention, is obtaining a laundry washing machine in which the recirculation circuit effectively dissolves the detergent and/or the washing/rinsing additive contained in the washing/rinsing liquid.

Applicant has found that, by locating the outlet opening of the recirculation circuit and the liquid inlet of the level detection device both on the sump, and respectively one on the first shell and the other on the second shell composing the tub, it is possible to effectively use the space within the cabinet, and therefore to arrange the recirculation circuit and the level detection device in an optimized way within the cabinet, allowing to fulfill the external dimensions constraints.

In particular, above aim is solved by a laundry washing machine comprising:

- a cabinet;
- a tub housed inside the cabinet, containing a drum rotatable with respect to a rotation axis, the tub comprising a first shell and a second shell fixed together and defining, at a bottom region of the tub, a sump;
- a draining circuit fluidly connected to the sump for draining liquid from the bottom of the latter;
- a level detection device configured for detecting the level of liquid within the tub and comprising an air chamber having a liquid inlet provided at the sump and in fluid communication with the internal of the latter;
- a recirculation circuit configured for withdrawing liquid from the tub and to re-admit such a liquid into the tub through an outlet opening positioned in the sump;
- wherein the outlet opening of the recirculation circuit and the liquid inlet of the level detection device are located one on the first shell and the other on the second shell.

Positioning the outlet opening of the recirculation circuit and the liquid inlet of the level detection device both on the sump, and one on the first shell and the other on the second shell allows positioning the recirculation circuit and the level detection device respectively in the vicinity of the two shells, and therefore to optimize the overall distribution of the components/devices within the cabinet.

In an advantageous embodiment, the cabinet defines a support plane on which the laundry washing machine is configured to lay, wherein the liquid inlet of the level detection device and the outlet opening of the recirculation circuit are located both on a same half-space with respect to a middle plane passing through the rotation axis of the drum and perpendicular to the support plane on which the laundry washing machine is configured to lay.

This particular positioning of the liquid inlet of the level detection device and the outlet opening of the recirculation circuit allows positioning both the level detection device and the recirculation circuit, at least partially, on a same side of the tub, and therefore to further optimize and make more rational the distribution of components/devices within the cabinet.

In an advantageous embodiment, the point or points of the surface on which the liquid inlet of the level detection device lays having the shortest distance from the middle plane has/have a first distance from the middle plane, and the point or points of the surface on which the outlet opening of the recirculation circuit lays having the shortest distance from the middle plane has/have a second distance from the middle plane, wherein the first distance is different from the second distance.

Preferably, all the points of the surface on which the liquid inlet of the level detection device lays have a distance from the middle plane which is different from the distance of any point of the surface on which the outlet opening of the recirculation circuit lays from the middle plane.

This advantageous choice of such distances contributes to prevent that that the jet of liquid emitted by the outlet opening of the recirculation circuit can disturb the detection of the level detection device.

In an advantageous embodiment, the point or points of the surface on which the liquid inlet of the level detection device lays having the lowest height with respect to the support plane has/have a first height with respect to the support plane, and the point or points of the surface on which the outlet opening of the recirculation circuit lays having the lowest height with respect to the support plane has/have a second height with respect to the support plane, wherein the first height is different from the second height.

This advantageous choice of such heights contributes to prevent that that the jet of liquid emitted by the outlet opening of the recirculation circuit can disturb the detection of the level detection device, since the outlet opening and the liquid inlet of the level detection device lay at least partially at different levels.

Preferably, the first height is higher than the second height; positioning the liquid inlet of the level detection device below the outlet opening of the recirculation circuit is advantageous, since in this way the level detection device can detect also very low liquid levels.

Preferably, all the points of the surface on which the liquid inlet lays have a height with respect to the support plane which is different from the height of any point of the surface on which the outlet opening lays with respect to the support plane.

In an advantageous embodiment, the outlet opening of the recirculation circuit is configured for supplying, within the sump, a jet of liquid having a direction of exit from the outlet opening which is substantially rectilinear and targets away from the liquid inlet of the level detection device.

This is advantageous, since in this way the risk that the jet of liquid and its path within the sump disturb the detection of the level detection device is reduced.

In an advantageous embodiment, the outlet opening of the recirculation circuit is configured for supplying, within the sump, a jet of liquid having a direction of exit from the outlet opening which is substantially rectilinear and targets directly the bottom of the sump.

This is advantageous, since in this way the risk that the jet of liquid disturbs the detection of the level detection device is further reduced, and, in addition, the jet of liquid can directly strike the bottom of the sump, washing away possible additive (e.g. detergent/softener) settled therein.

In an advantageous embodiment, the outlet opening of the recirculation circuit is configured for supplying, within the sump, a jet of liquid having a direction of exit from the outlet opening which is substantially rectilinear and targets directly the middle plane.

This is advantageous, since in this way the jet of liquid can reach relatively long distances within the tub reducing the risk that said jet disturbs the detection of the level detection device.

In an advantageous embodiment, the laundry washing machine comprises one or more conveying elements configured for channeling a liquid from the internal of the sump to the liquid inlet of the level detection device. This ensures an effective detection of the liquid level.

In an advantageous embodiment, the one or more conveying elements comprise a first portion of a lateral wall of the sump, connected to the border of the liquid inlet, and inclined towards the external of the sump to define, with respect to the rest of the lateral wall, a lateral recess fluidly connecting the internal of the sump to the liquid inlet. The lateral recess contributes shield the liquid inlet from the movements of the liquid within the sump, for example due to the functioning of the recirculation circuit or the rotation of the drum within the tub, that could disturb the detection of the level detection device.

Preferably, the first portion has an arched profile promoting the passage of liquid from the sump to the liquid inlet.

In an advantageous embodiment, the sump comprises a partition wall positioned between the liquid inlet and the outlet opening of the recirculation circuit in such a way that a straight line connecting any point of the surface on which the outlet opening lays to any point of the surface on which the liquid inlet lays crosses the partition wall.

This is advantageous, since a physical separation between the liquid inlet and the outlet opening of the recirculation circuit promotes, at least in the region of the inlet and the opening, a separation between the liquid paths, limiting the risk that the jet of liquid exiting the outlet opening could directly impact the liquid inlet, disturbing the detection of the level detection device.

In an advantageous embodiment, the partition wall defines the upper wall of the lateral recess.

In an advantageous embodiment, the first shell comprises a first flange, and the second shell comprises a second flange, fixed to the first flange, wherein the air chamber of the level detection device is defined between a first wall belonging to the first flange and a second wall belonging to the second flange. This is advantageous and simplifies the structure and the assembly process of the laundry washing machine, since the air chamber can be obtained simply by the connection of the first and second shell.

In a preferred embodiment, one or both the first wall and the second wall are bulge-shaped.

In a preferred embodiment the first wall and/or the second wall is L-shaped, so as to define a first wing, comprising the liquid inlet, that develops along a direction substantially parallel to the support plane, and a contiguous second wing that develops along a direction substantially perpendicular to the support plane.

In an advantageous embodiment, the laundry washing machine comprises a through-hole, provided at the first wall and/or second wall, fluidly connecting the internal of the air chamber to a connecting element protruding, respectively, from the first wall and/or second wall towards the external of the air chamber, and fluidly connected or connectable to a sensing element of the level detection device.

In an advantageous embodiment, the laundry washing machine comprises a nozzle, at least partially protruding from one between the first shell and the second shell towards the internal of the sump, wherein the outlet opening of the recirculation circuit is provided at the outlet of the nozzle.

Preferably, the nozzle leans on or is a single body with the partition wall.

In an advantageous embodiment, the laundry washing machine comprises one or more guiding elements configured for channeling towards the bottom of the sump and/or towards the middle plane, a jet of liquid coming from the outlet opening of the recirculation circuit.

Preferably, the one or more guiding elements comprise a second portion of the lateral wall of the sump shaped and/or positioned in such a way to receive a jet of liquid coming from the outlet opening and to channel this jet towards the bottom of the sump and/or towards the middle plane.

BRIEF DESCRIPTION OF THE DRAWINGS

Other advantages and features of a laundry washing machine according to the present invention will be clear from the following detailed description, provided only as a not limitative example, in which.

In the figures same parts are indicated with the same reference numbers.

DETAILED DESCRIPTION OF EXEMPLARY EMBODIMENTS

Figure 2:
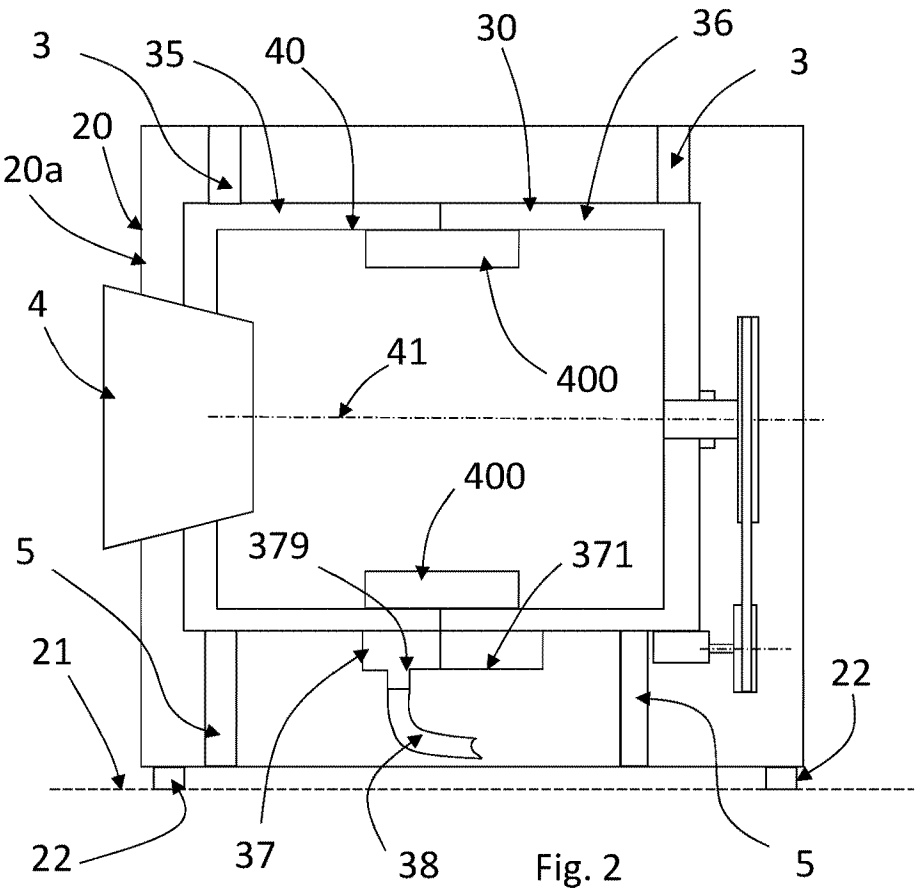
FIG. 2 is a schematic lateral cross section of a washing machine according to the invention, with some parts not illustrated.
Figure 1:
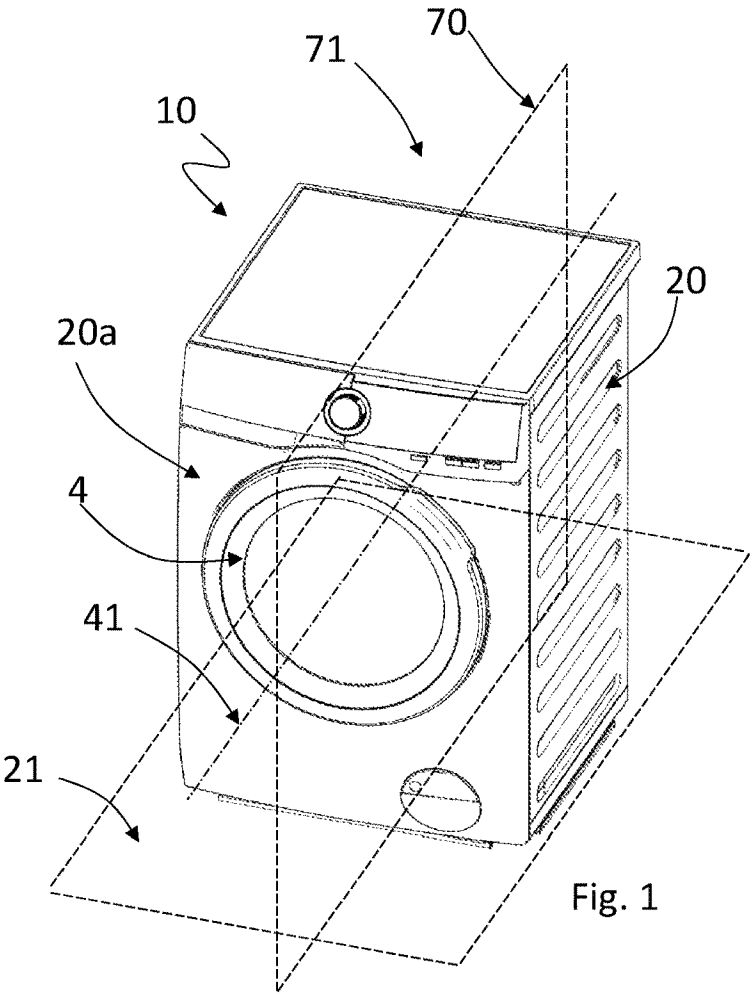
FIG. 1 is a perspective view of a laundry washing machine according to the invention.
Figure 3:
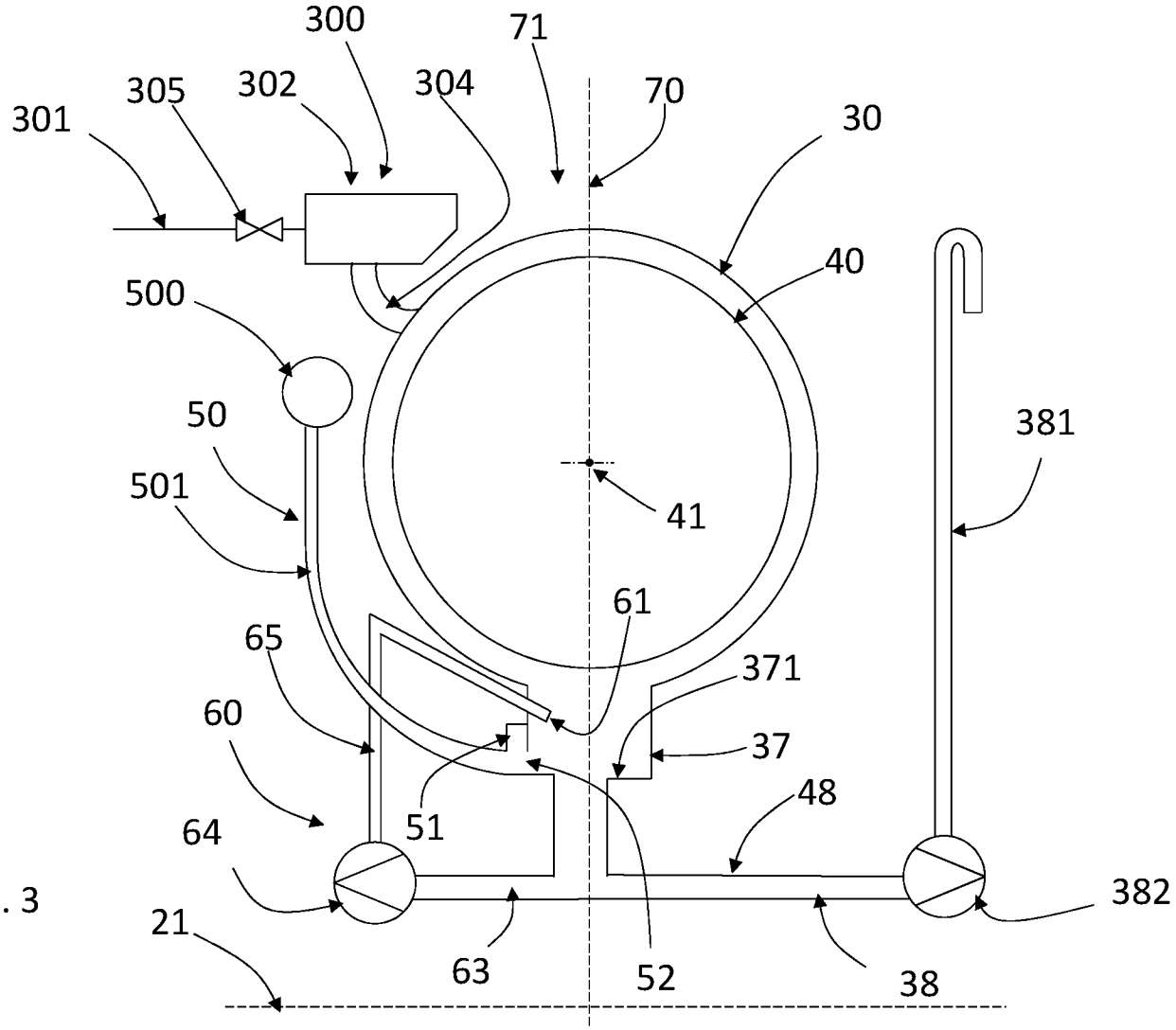
FIG. 3 is a schematic frontal cross section of a washing machine according to the invention, with some parts not illustrated.

Advantageously, the laundry washing machine 10 illustrated in attached figures are of the front-loading type; it is however clear that the invention can be applied, without any substantial modification, also to top-loading washing machines, both of the "horizontal axis" and of the "vertical axis" type.

In addition, the invention can be applied, without any substantial modification, also to washer-driers.

The laundry washing machine 10 comprises a cabinet 20, or housing, preferably substantially parallelepiped, advantageously defining a support plane 21 on which the laundry washing machine 10 is configured to lay.

For example, the cabinet 20 can be advantageously provided with feet 22 configured to be positioned on a horizontal surface, for example the floor of a building; in this case, the support plane 21 is a plane defined by the points of the feet 22 leaning on the horizontal surface.

Advantageously, in the frontal wall 20*a* of the cabinet 20 an access opening, not illustrated, is preferably obtained, advantageously selectively closable by a loading/unloading door 4, preferably hinged to the frontal wall 20*a*.

The laundry washing machine 10 comprises a tub 30, preferably suspended to the cabinet 20 through springs 3 and dampers 5, wherein a washing liquid (water or water mixed with a washing/rinsing additive) can be loaded.

Advantageously, the tub 30 comprises a first shell 35 and a second shell 36, advantageously made of plastics and fixed together (e.g. by welding) in such a way that the connection is watertight; the shells are so shaped to define, at a bottom region of the tub 30, a sump 37, which is fluidly connected to a draining circuit 38 for draining liquid from the bottom 371 of the latter. Preferably, the sump 37 is fluidly connected to the draining circuit 38 via a draining hole 379 provided at the bottom 371 of the sump 37.

Advantageously, the draining circuit 38 comprises one or more draining ducts 381 and a draining pump 382, configured for withdrawing liquid from the bottom 371 of the sump 37 and draining a such liquid outside the laundry washing machine 10.

The washing machine 10 advantageously comprises a water inlet circuit 300, adapted to feed water or water mixed with washing/rinsing additives (e.g. detergent, softener) into the tub 30; the water inlet circuit 300 can advantageously comprise a water pipe 301, a first end of which is preferably connected or connectable to the water mains of a building (not illustrated), and a second end of which is preferably arranged in such a way to take water coming from its first end to the internal of an additive drawer 302, so that such water can mix with an additive (e.g. a detergent and/or a softener) contained therein, before being admitted into the washing tub 30 via a suitable duct 304.

Preferably, the water inlet circuit comprises an electrovalve 305, configured for selectively allowing or preventing the passage of water from the water pipe 301 to the additive drawer 302.

Advantageously, the tub 30 contains a drum 40 rotatable with respect to a rotation axis 41.

Advantageously, as in the examples illustrated in attached Figures, the laundry washing machine 10 comprises at least one (preferably two or more) lifter 400 (called also elevator, or rib, or diverter), adapted to improve the stirring of the laundry during the rotation of the drum 40.

The laundry washing machine 10 comprises a recirculation circuit 60 configured for withdrawing liquid from the tub 30 and to re-admit such a liquid into the tub 30 through an outlet opening 61 positioned in the sump 37.

Advantageously, the recirculation circuit 60 comprises a recirculation pump 64 configured for withdrawing liquid from the bottom 371 of the sump 37, preferably via a first recirculation duct 63 connected between the recirculation pump 64 and the draining hole 379, and for taking such a liquid to the outlet opening 62 via a second recirculation duct 65.

Advantageously, the recirculation circuit comprises nozzle 610, at least partially protruding from one between said first shell 35 and the second shell 36 towards the internal of the sump 37; in this case the outlet opening 61 of the recirculation circuit 60 can be advantageously provided at the outlet of the nozzle 610.

The laundry washing machine 10 comprises also a level detection device 50 configured for detecting the level of liquid within the tub 30.

The level detection device 50 comprises an air chamber 51 having a liquid inlet 52 provided at the sump 37 and in fluid communication with the internal of the latter.

According to the invention, the outlet opening 61 of the recirculation circuit 60 and the liquid inlet 52 of the level detection device 50 are located one on the first shell 35 and the other on the second shell 36.

In an advantageous embodiment, like the one illustrated in attached figures, the first shell 35 comprises a first flange 350, and the second shell 36 comprises a second flange 360, fixed to the first flange 351, and the air chamber 51 of the level detection device 50 is defined between a first wall 351 belonging to the first flange 350 and a second wall 361 belonging to the second flange 360.

Advantageously, one or both the first wall 351 and the second wall 361 are bulge-shaped.

In an advantageous embodiment, like the one illustrated in attached figures, the second wall 361 is advantageously bulge-shaped, while the first wall 351 is flat, or substantially flat.

Advantageously, the first wall 351 and/or the second wall 361 is L-shaped so as to define a first wing 361*a*, comprising the liquid inlet 52, that develops along a direction substantially parallel to the support plane 21, and a contiguous second wing 361*b* that develops along a direction substantially perpendicular to the support plane 21.

In an advantageous embodiment, like the one illustrated in attached figures, the second wall 361 is advantageously bulge-shaped, it is L-shaped, while the first wall 351 is substantially flat; in this case, the first flange 351 is fixed to the second flange 360 in such a way that the first wall 351 abuts against the second wall 361 at the second wing 361*b* of the latter and partially at its first wing 361*a*, defining the air chamber therebetween, and leaving anyway the liquid inlet 52 opened and accessible from the internal of the sump 37.

Advantageously, the laundry washing machine 10 comprises a through-hole 510, provided at the first wall 351 and/or at the second wall 361, fluidly connecting the internal of the air chamber 51 to a connecting element 511 protruding, respectively, from the first wall 351 and/or second wall 361 towards the external of the air chamber 51, and fluidly connected or connectable, for example by a suitable pipe 501, to a sensing element 500 of the level detection device 50.

Advantageously the sensing element 500 can be a pressure sensor.

Advantageously, the sensing element 500 can comprise an integrated electronic unit, not illustrated, configured for calculating/determining the liquid level within the tub 300 from the detected pressure.

In an advantageous embodiment, the sensing element 500 is operatively connected to an electronic unit, not illustrated, for example the control unit of the laundry washing machine 10, configured for calculating the liquid level within the tub 300 from the pressure detected by the sensing element 500.

In an advantageous embodiment, like the one illustrated in attached figures, the through-hole 510, and the connecting element 511 are both provided at the first wall 351.

In a further advantageous embodiment, not illustrated, the through-hole 510 can be provided at the interface between the first wall 351 and the second wall 361 (in other words, a first portion of the through-hole 510 can be provided at the first wall 351, and a second portion of the through-hole 510 can be provided at the second wall 361, in such a way that the two portions match one another when the fist wall 351 is fixed to the second wall 361 to define the air chamber 51); in this case, advantageously, also the connecting element 511 can comprise a first part on the first wall 351 and a second part on the second wall 361, the first and second parts matching one another when the fist wall 351 is fixed to the second wall 361 to define the air chamber 51.

In an advantageous embodiment, like the one illustrated in attached figures, the laundry washing machine 10 comprises one or more conveying elements 370 configured for channeling a liquid from the internal of the sump 37 to the liquid inlet 52 of the level detection device 50.

In an advantageous embodiment, like the one illustrated in attached figures, the one or more conveying elements 370 comprise a first portion 372 of a lateral wall 373 of the sump 37, connected to the border of the liquid inlet 52, and inclined towards the external of the sump 37 to define, with respect to the rest of the lateral wall 373 thereof, a lateral recess 374 fluidly connecting the internal of the sump 37 to the liquid inlet 52. The lateral recess 374 is therefore a sort of niche protruding from the lateral wall 373 of the sump 37 in the opposite direction to the center of the sump 37.

Preferably, as in the example of attached figures, the first portion 372 has an arched profile promoting the passage of liquid from the sump 37 to the liquid inlet 52.

In an advantageous embodiment, like the one illustrated in attached figures, the sump 37 comprises a partition wall 375 positioned between the liquid inlet 52 and the outlet opening 61 of the recirculation circuit 60 in such a way that a straight line connecting any point of the surface on which the outlet opening 61 lays to any point of the surface on which the liquid inlet 52 lays crosses the partition wall 375; the partition wall 375 defies therefore a barrier interposed between the outlet opening 61 and the liquid inlet 52, preventing a liquid exiting the outlet opening 61 to reach the liquid inlet 52 via a straight path.

In an advantageous embodiment, like the one illustrated in attached figures, the partition wall 375 defines the upper wall of the lateral recess 374.

In an advantageous embodiment, like the one illustrated in attached figures, the nozzle 610 leans on or is a single body with the partition wall 375.

In an advantageous embodiment, like the one illustrated in attached figures, the liquid inlet 52 of the level detection device 60 and the outlet opening 61 of the recirculation circuit 60 are located both on a same half-space 71 with respect to a middle plane passing through the rotation axis 41 of the drum 40 and perpendicular to the support plane 21 on which the laundry washing machine 10 is configured to lay.

In an advantageous embodiment, like the one illustrated in attached figures, the point or points of the surface on which the liquid inlet 52 of the level detection device 50 lays having the shortest distance from the middle plane 70 has/have a first distance d1 from the middle plane 70, and the point or points of the surface on which the outlet opening 61 of the recirculation circuit 60 lays having the shortest distance from the middle plane 70 has/have a second distance d2 from the middle plane 70; advantageously, the first distance d1 is different from the second distance d2.

In a preferred embodiment, like the one illustrated in attached figures, all the points of the surface on which the liquid inlet 52 of the level detection device 50 lays have a distance from the middle plane 70 which is different from the distance of any point of the surface on which the outlet opening 61 of the recirculation circuit 60 lays from the middle plane 70.

Figure 4:
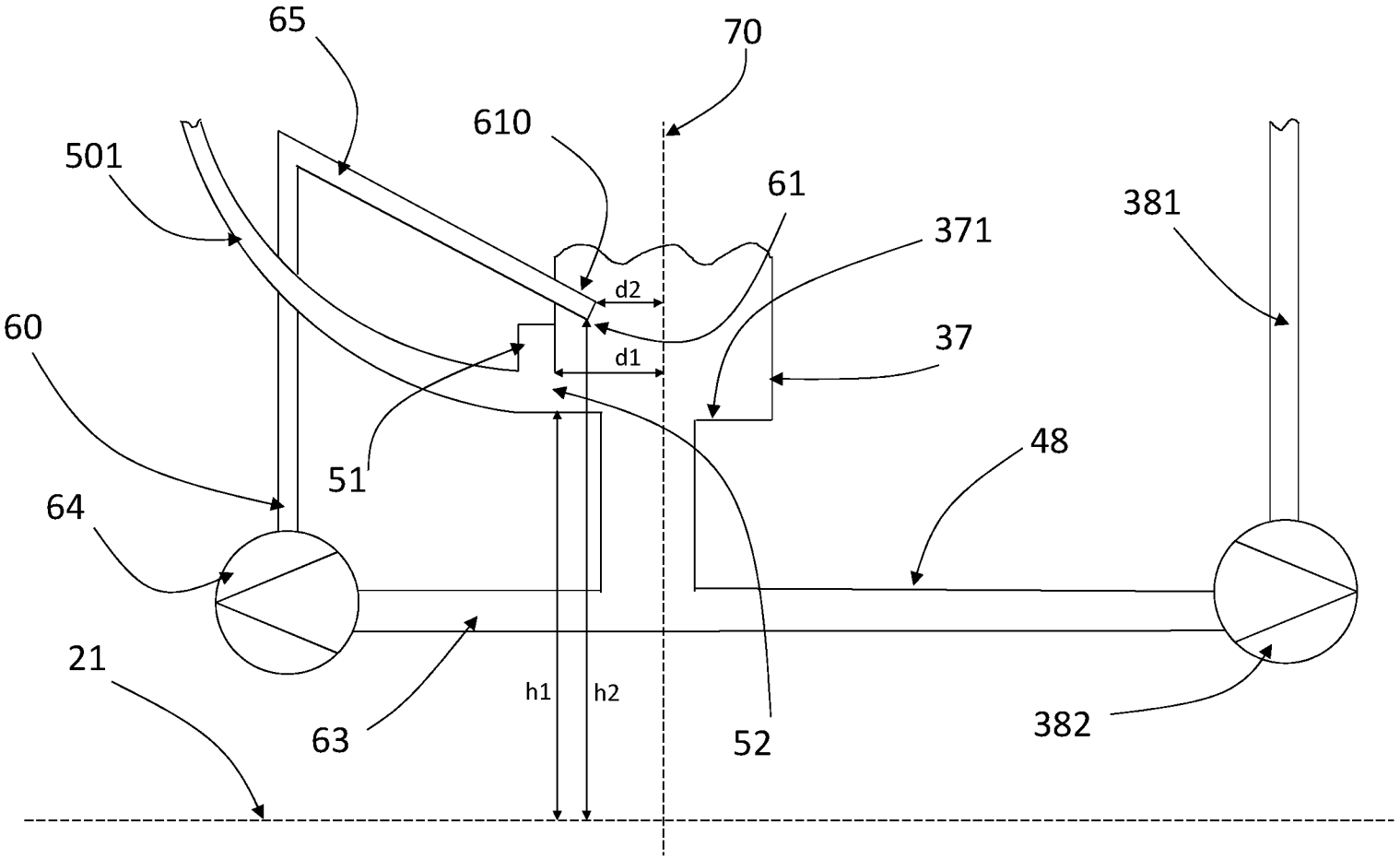
FIG. 4 is an enlarged detail of FIG. 3.
Figure 5:
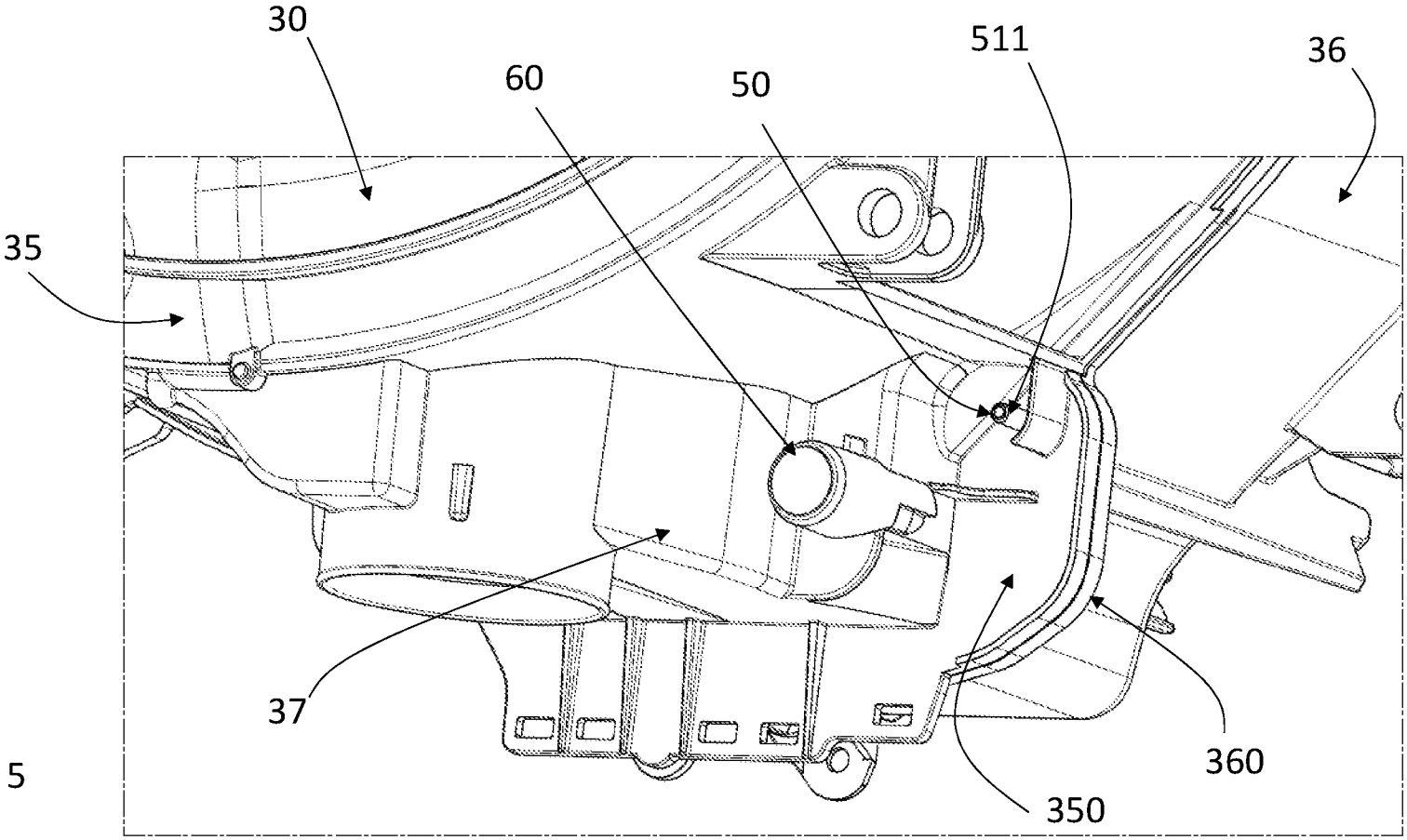
FIG. 5 is a perspective view of a portion of the tub of a laundry washing machine according to the invention.
Figure 6:
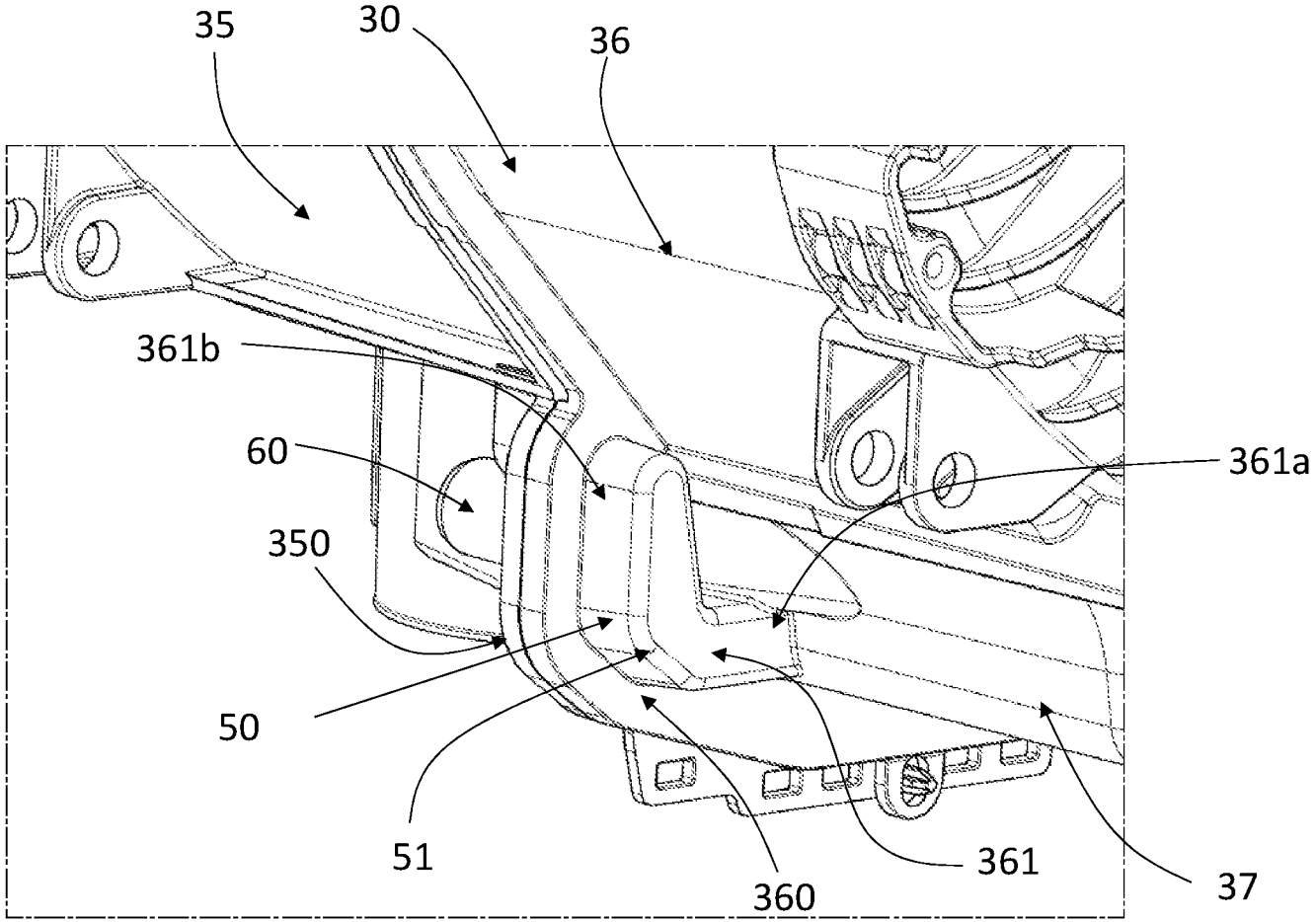
FIG. 6 is a further perspective view of a portion of the tub of a laundry washing machine according to the invention.
Figure 7:
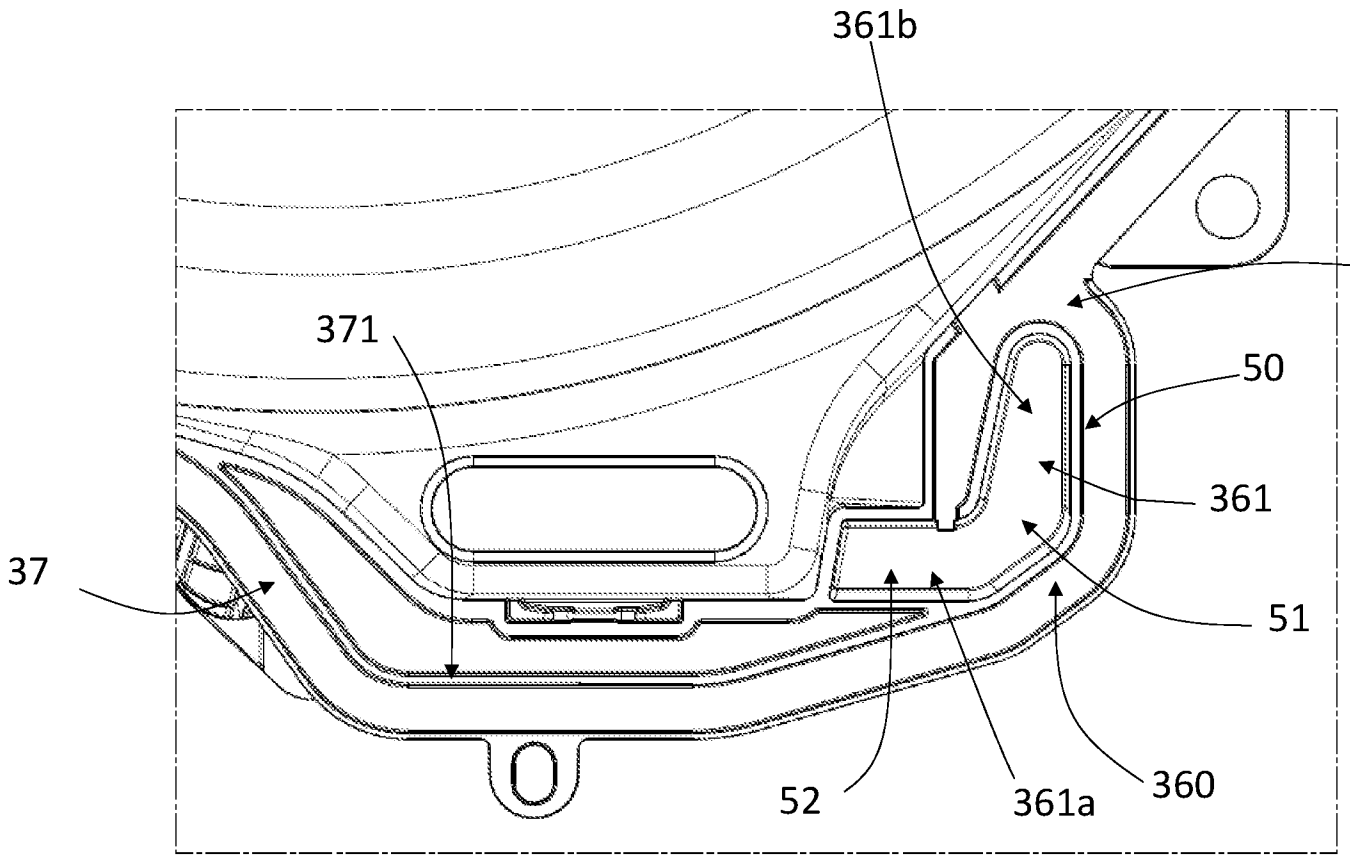
FIG. 7 is a front view of a portion of a second shell of the tub of a laundry washing machine according to the invention.
Figure 8:
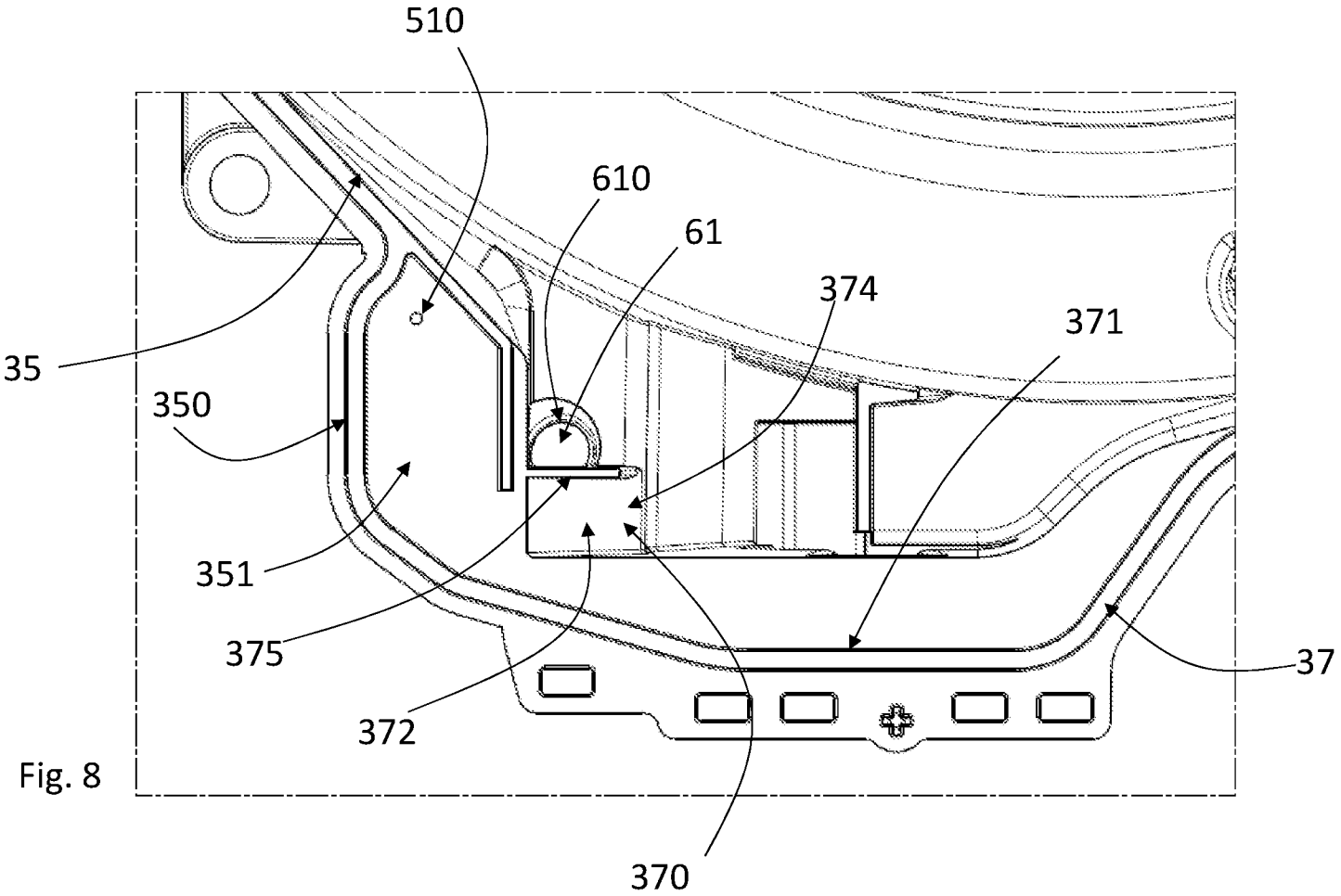
FIG. 8 is a front view of a portion of a first shell of the tub of a laundry washing machine according to the invention.
Figure 9:
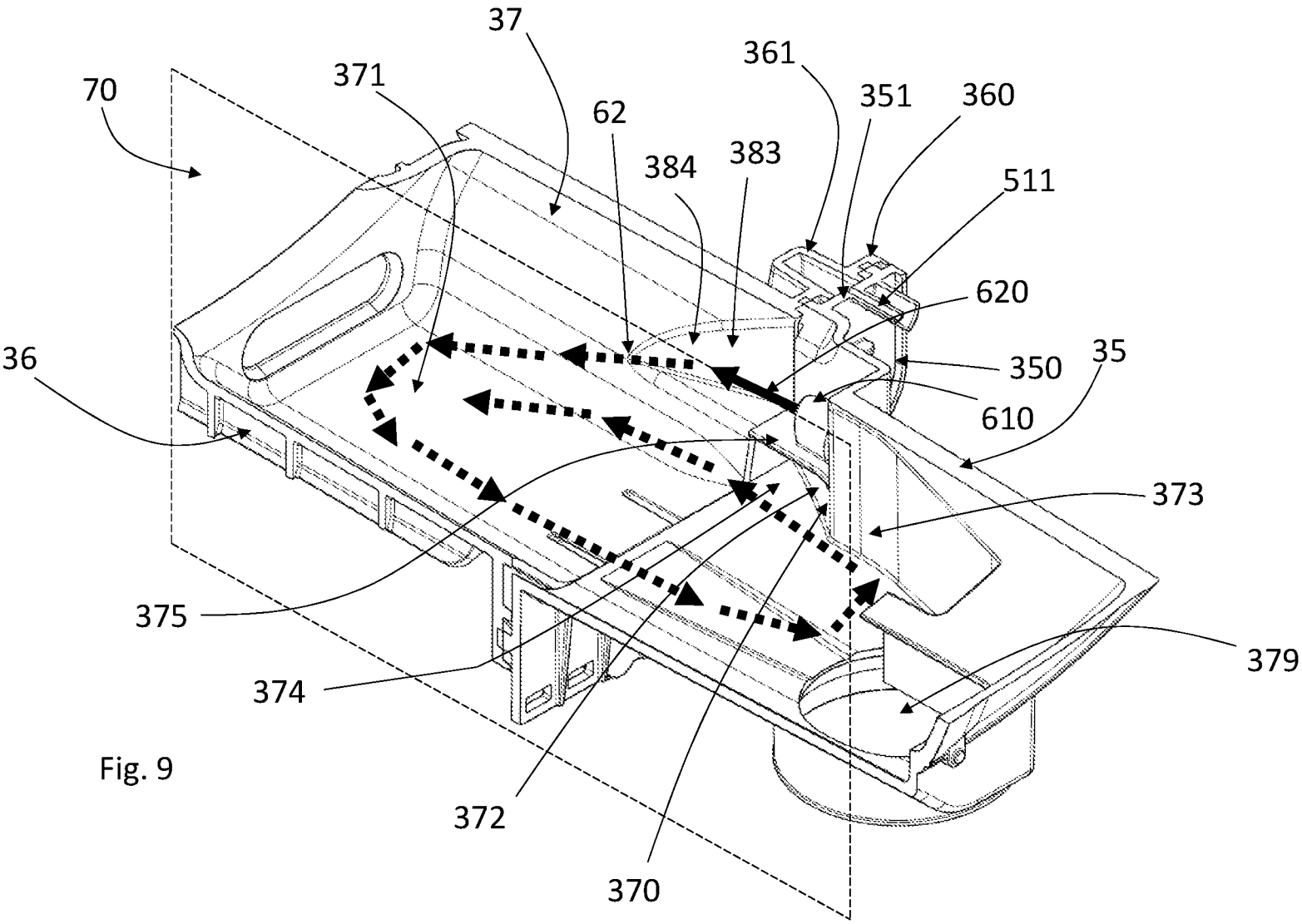
FIGS. 9 to 11 are a perspective views of portions of the sump of a laundry washing machine according to the invention.
Figure 10:
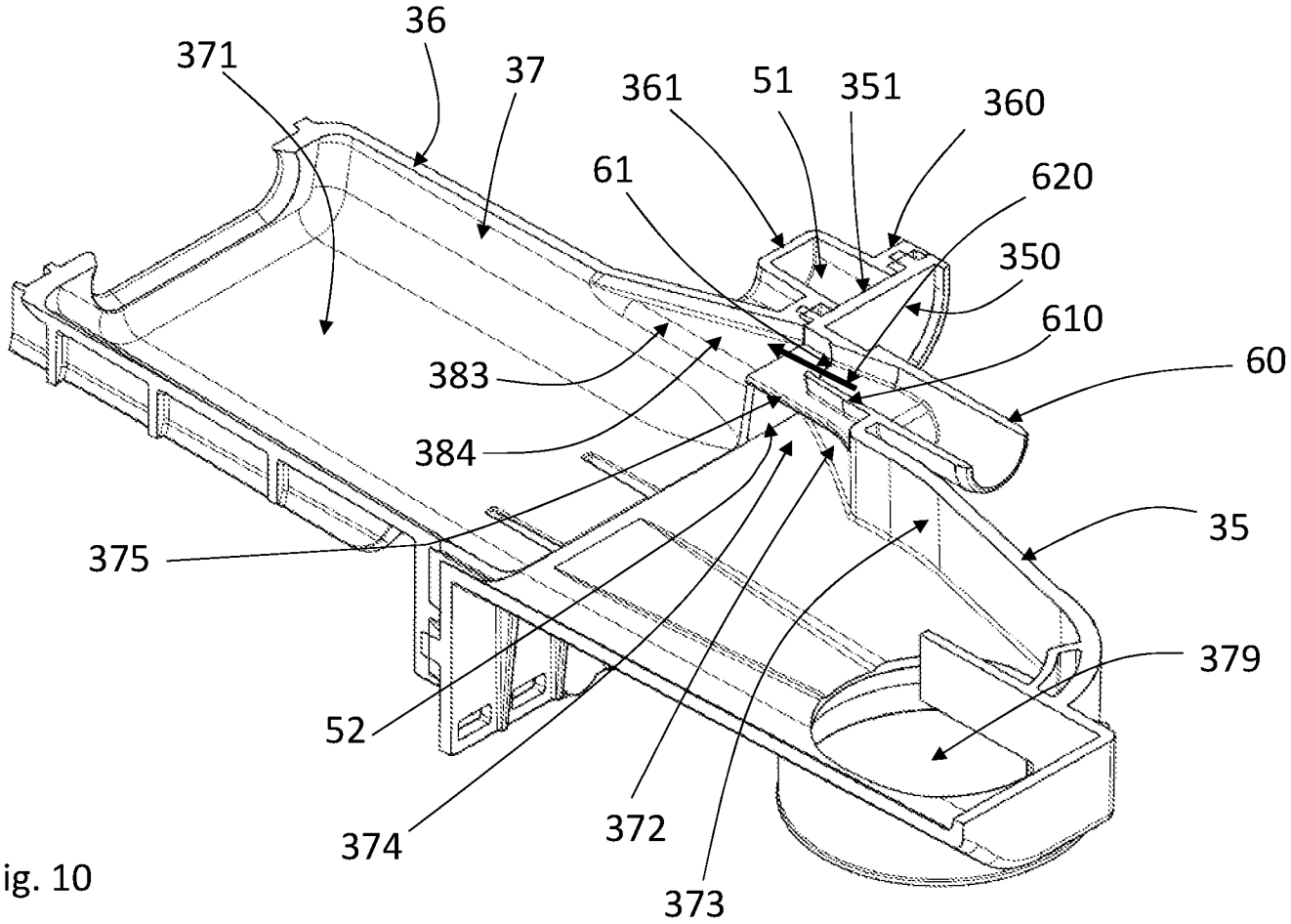
Figure 11:
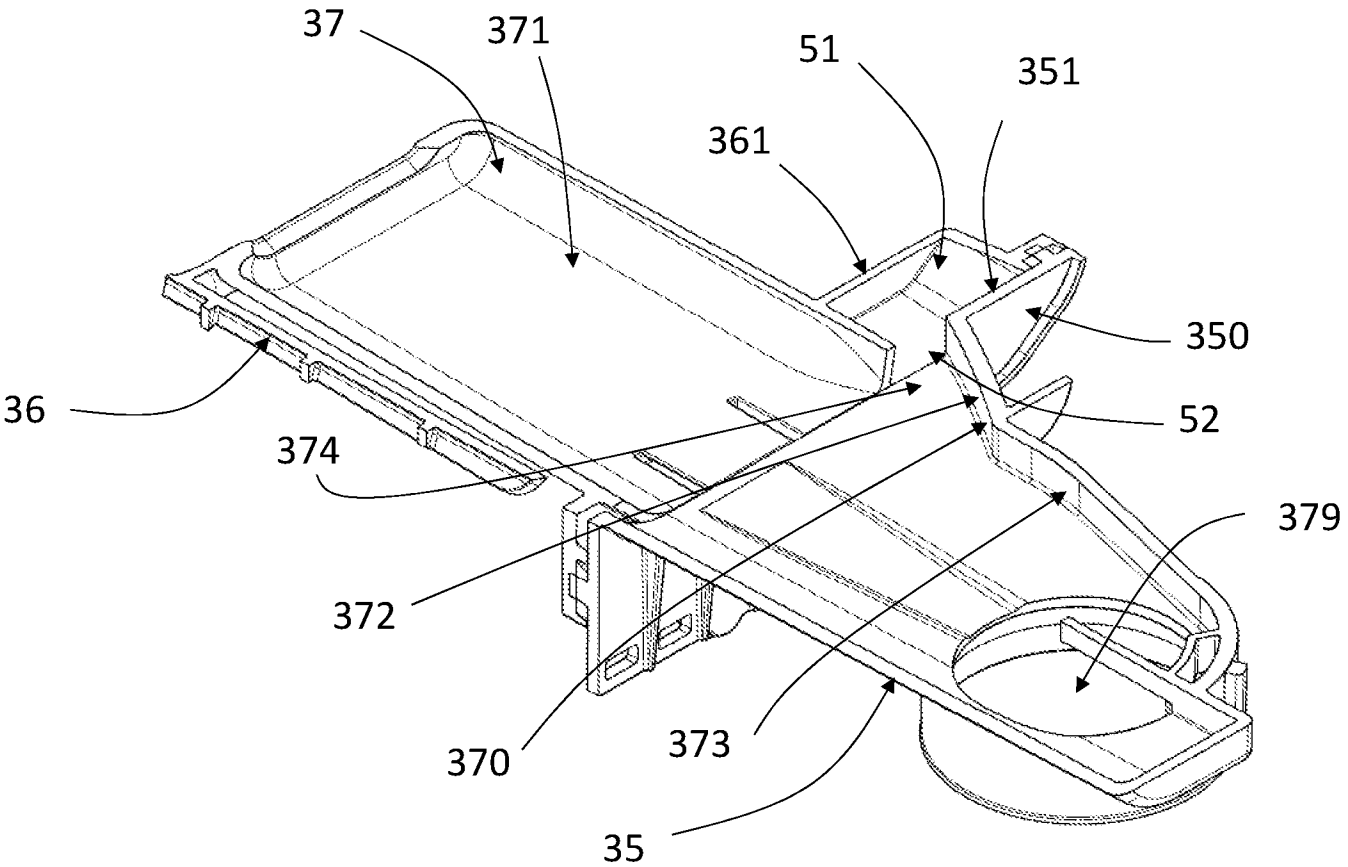

In the advantageous embodiment of FIG. 4, all the points of the surface on which the liquid inlet 52 lays have a same distance, coinciding with the first distance d1, from the middle plane 70; in this advantageous example, this distance d1 is higher than the distance of any point of the surface on which the outlet opening 61 of the recirculation circuit 60 lays from the middle plane 70 (and therefore also of the distance d2 defined as the distance of the point or points of the surface on which the outlet opening 61 of the recirculation circuit 60 lays having the shortest distance from the middle plane 70).

It is underlined that the distance of a point of the surface on which the liquid inlet 52 lays or of the surface on which the outlet opening 61 lays from the middle plane 70 is defined as the length of a segment perpendicular of the middle plane 70, connecting the latter to such a point.

In a preferred embodiment, like the one illustrated in attached figures, the point or points of the surface on which said liquid inlet 52 of the level detection device 50 lays having the lowest height with respect to the support plane 21 has/have a first height h1 with respect to the support plane 21, and the point or points of the surface on which the outlet opening 61 of the recirculation circuit 60 lays having the lowest height with respect to said support plane 21 has/have a second height h2 with respect to the support plane 21; advantageously, the first height h1 is different from the second height h2.

In a preferred embodiment, like the one illustrated in attached figures the first height h1 is higher than the second height h2.

In a preferred embodiment, like the one illustrated in attached figures all the points of the surface on which the liquid inlet 52 lays have a height with respect to the support plane 21 which is different from the height of any point of the surface on which the outlet opening 61 lays with respect to the support plane 21.

It is underlined that the height of a point of the surface on which the liquid inlet 52 lays or of the surface on which the outlet opening 61 lays with respect to the support plane 21 is defined as the length of a segment perpendicular to the support plane 21, connecting the latter to such a point.

In a preferred embodiment, like the one illustrated in attached figures the outlet opening 61 of the recirculation circuit 60 is configured for supplying, within the sump 37, a jet 62 of liquid having a direction of exit 620 from the outlet opening 61 which is substantially rectilinear and targets away from the liquid inlet 52 of the level detection device 50; in other words this means that when the jet 62 exits the outlet opening 61 it has mainly (i.e. with the exception of possible droplets of sprinkles) a direction that is substantially rectilinear (i.e. rectilinear with the exception of the deflection of the jet 62 due to gravity) and that, if the jet 62 is not deflected by anything but gravity (which naturally bents the jet 62 towards the earth), by proceeding along this substantially rectilinear direction it would not reach the liquid inlet 52 (for example since there is something therebetween, or because the substantially rectilinear direction, taking into account its deflection due to gravity, does not point to the liquid inlet 52).

In an advantageous embodiment, like for example the one illustrated in attached figures, the outlet opening 61 of the recirculation circuit 60 is configured for supplying, within the sump 37, a jet 62 of liquid having a direction of exit 620 from the outlet opening 61 which is substantially rectilinear and targets directly the bottom 371 of the sump 37; in other words this means that when the jet 62 exits the outlet opening 61 it has mainly (i.e. with the exception of possible droplets of sprinkles) a direction that is substantially rectilinear (i.e. rectilinear with the exception of the deflection of the jet 62 due to gravity) and that, if the jet 62 is not deflected by anything but gravity (which naturally bents the jet 62 towards the earth), by proceeding along this substantially rectilinear direction, taking into account its deflection due to gravity, it would strike the bottom 371 of the sump.

In an advantageous embodiment, like for example the one illustrated in attached figures, the outlet opening 61 of the recirculation circuit 60 is configured for supplying, within the sump 37, a jet 62 of liquid having a direction of exit 620 from the outlet opening 61 which is substantially rectilinear and targets directly the middle plane 70; in other words this means that when the jet 62 exits the outlet opening 61 it has mainly (i.e. with the exception of possible droplets of sprinkles) a direction that is substantially rectilinear (i.e. rectilinear with the exception of the deflection of the jet 62 due to gravity) and that, if the jet 62 is not deflected by anything but gravity (which naturally bents the jet 62 towards the earth), by proceeding along this substantially rectilinear direction, taking into account its deflection due to gravity, it would reach the middle plane 70.

In an advantageous embodiment, like for example the one illustrated in attached figures, the laundry washing machine 10 comprises one or more guiding elements 383 configured for channeling towards the bottom 371 of the sump 37 and/or towards the middle plane 70, a jet 62 of liquid coming from the outlet opening 61.

In an advantageous embodiment, like the one illustrated in attached figures, the one or more guiding elements 383 comprise a second portion 384 of the lateral wall 373 of the sump 37 shaped and/or positioned in such a way to receive a jet 62 of liquid coming from the outlet opening 61 and to channel this jet 62 towards the bottom 371 of the sump 37 and/or towards the middle plane 70.

The functioning of the laundry washing machine 10 according to the invention is described in the following.

After loading the laundry to be washed in the drum 40, a washing cycle can be started; during the washing cycle a washing/rinsing liquid containing water mixed with a washing/rinsing additive is loaded into the tub 30, for example by the water inlet circuit 300.

By activating the recirculation circuit 60, the washing/rinsing liquid is repeatedly and continuously withdrawn from the tub 30 and re-admitted into the tub 30 through an outlet opening 61 positioned in the sump 37; in this way the washing/rinsing liquid is effectively stirred and the washing/rinsing additive effectively diluted tin the water.

During the washing cycle, when washing/rinsing liquid contained in the sump 37 of the tub 30 reaches a certain level at which it enters the liquid inlet 52 of the air chamber 51, such a washing/rinsing liquid compresses the air contained in the air chamber 51, which pressure is transmitted by the through-hole 510, the connecting element 511, and the duct 501, to the sensing element 500, for example a pressure sensor, configured for detecting the pressure in the air chamber 51.

The pressure detected by the control unit 500 is then used, directly by the sensing element 500 (e.g. if provided with an integrated electronic unit), or by an external electronic unit, e.g. the control unit of the laundry washing machine 10, to which the sensing element 500 is connected, for calculating the level of the liquid within the tub.

Such a liquid level can be then advantageously used, e.g. by the control unit of the laundry washing machine 10, as a reference parameter for controlling one or more phases and/or further parameters of the washing cycle.

It is seen therefore how the invention achieves the proposed aim and objects, there being provided a laundry washing machine that thanks to the reciprocal positioning of the outlet opening of the recirculation circuit and of the liquid inlet of the level detection device, it is possible to effectively use the space within the cabinet, and therefore to arrange the recirculation circuit and the level detection device in an optimized way within the cabinet, allowing to fulfill the external dimensions constraints.

In addition, the inventive reciprocal positioning of the outlet opening of the recirculation circuit and of the liquid inlet of the level detection device allows reducing the risk that the jet of liquid of the recirculation circuit disturbs the detection of the level detection device.

REFERENCE NUMBERS

3 springs
4 loading/unloading door
5 dampers
10 laundry washing machine
20 cabinet or housing
20*a* frontal wall
21 support plane
22 feet
30 tub
35 first shell
36 second shell
37 sump
38 draining circuit
40 drum
41 rotation axis
50 level detection device
51 air chamber
52 liquid inlet
60 recirculation circuit
61 outlet opening
62 jet
63 first recirculation duct
64 recirculation pump
65 second recirculation duct
70 middle plane
71 half-space
300 water inlet circuit
301 water pipe
302 additive drawer
304 duct
305 electro-valve
350 first flange
351 first wall
360 second flange
361 second wall
361*a* first wing
370 conveying elements
371 bottom
372 first portion
373 lateral wall
374 lateral recess
375 partition wall
381 draining ducts
382 draining pump
383 guiding elements
384 second portion
400 lifter
500 sensing element
510 through-hole
511 connecting element
610 nozzle
620 direction of exit
d1 first distance
d2 second distance
h1 first height
h2 second height

The invention claimed is:

1. A laundry washing machine comprising:

a cabinet;

a tub housed inside said cabinet, said tub comprising a first shell and a second shell fixed together and defining a sump at a bottom region of said tub;

a drum contained in said tub and rotatable about a rotation axis;

a draining circuit fluidly connected to said sump and configured to drain liquid from the sump;

a level detection device configured to detect a level of liquid within said tub, said level detection device comprising an air chamber having a liquid inlet provided at said sump and in fluid communication with an internal volume of the sump; and a recirculation circuit configured to withdraw liquid from said tub and to re-admit said liquid into said tub through an outlet opening positioned in said sump;

wherein one of said outlet opening of said recirculation circuit and said liquid inlet of said level detection device is located on said first shell, and the other of said outlet opening of said recirculation circuit and said liquid inlet is located on said second shell.

2. The laundry washing machine according to claim 1, wherein said cabinet defines a support plane on which said laundry washing machine is configured to lay, wherein said liquid inlet of said level detection device and said outlet opening of said recirculation circuit are located both on a same half-space with respect to a middle plane passing through said rotation axis of said drum and perpendicular to said support plane.

3. The laundry washing machine according to claim 2, wherein a point or points of the surface on which said liquid inlet of said level detection device lays having a shortest distance from said middle plane has/have a first distance from said middle plane, and a point or points of the surface on which said outlet opening of said recirculation circuit lays having a shortest distance from said middle plane has/have a second distance from said middle plane, wherein said first distance is different from said second distance.

4. The laundry washing machine according to claim 1, wherein a point or points of the surface on which said liquid inlet of said level detection device lays having a lowest height with respect to said support plane has/have a first height with respect to said support plane, and a point or points of the surface on which said outlet opening of said recirculation circuit lays having a lowest height with respect to said support plane has/have a second height with respect to said support plane, wherein said first height is different from said second height.

5. The laundry washing machine according to claim 4, wherein said first height is greater than said second height.

6. The laundry washing machine according to claim 1, wherein said outlet opening of said recirculation circuit is configured to supply, within said sump, a jet of liquid having a direction of exit from said outlet opening, wherein the direction if exit is substantially rectilinear and targets away from said liquid inlet of said level detection device.

7. The laundry washing machine according to claim 1, further comprising one or more conveying elements configured to channel a liquid from an internal volume of said sump to said liquid inlet of said level detection device.

8. The laundry washing machine according to claim 7, wherein said one or more conveying elements comprise a first portion of a lateral wall of said sump, connected to a border of said liquid inlet, and inclined towards the external of said sump to define, with respect to a remainder of said lateral wall, a lateral recess fluidly connecting the internal volume of said sump to said liquid inlet.

9. The laundry washing machine according to claim 1, wherein said sump comprises a partition wall positioned between said liquid inlet and said outlet opening of said recirculation circuit in such a way that a straight line connecting any point of the surface on which said outlet opening lays to any point of the surface on which said liquid inlet lays crosses said partition wall.

10. The laundry washing machine according to claim 8, wherein:

said sump comprises a partition wall positioned between said liquid inlet and said outlet opening of said recirculation circuit in such a way that a straight line connecting any point of the surface on which said outlet opening lays to any point of the surface on which said liquid inlet lays crosses said partition wall; and said partition wall defines an upper wall of said lateral recess.

11. The laundry washing machine according to claim 1, wherein said first shell comprises a first flange, and said second shell comprises a second flange, fixed to said first flange, wherein said air chamber of said level detection device is defined between a first wall belonging to said first flange and a second wall belonging to said second flange.

12. The laundry washing machine according to claim 11, further comprising a through-hole, provided at said first wall and/or second wall, fluidly connecting an internal volume of said air chamber to a connecting element protruding, respectively, from said first wall and/or second wall towards the external of said air chamber, and fluidly connected or connectable to a sensing element of said level detection device.

13. The laundry washing machine according to claim 1, further comprising a nozzle, at least partially protruding from one between said first shell and said second shell towards the internal of said sump, wherein said outlet opening of said recirculation circuit is provided at the outlet of said nozzle.

14. The laundry washing machine according to claim 1, further comprising one or more guiding elements configured to channel towards said bottom of said sump and/or towards said middle plane, a jet of liquid coming from said outlet opening of said recirculation circuit.

15. The laundry washing machine according to claim 14, wherein said one or more guiding elements comprise a second portion of said lateral wall of said sump shaped and/or positioned in such a way to receive a jet of liquid coming from said outlet opening and to channel said jet towards said bottom of said sump and/or towards said middle plane.

* * * * *